Figure 1:
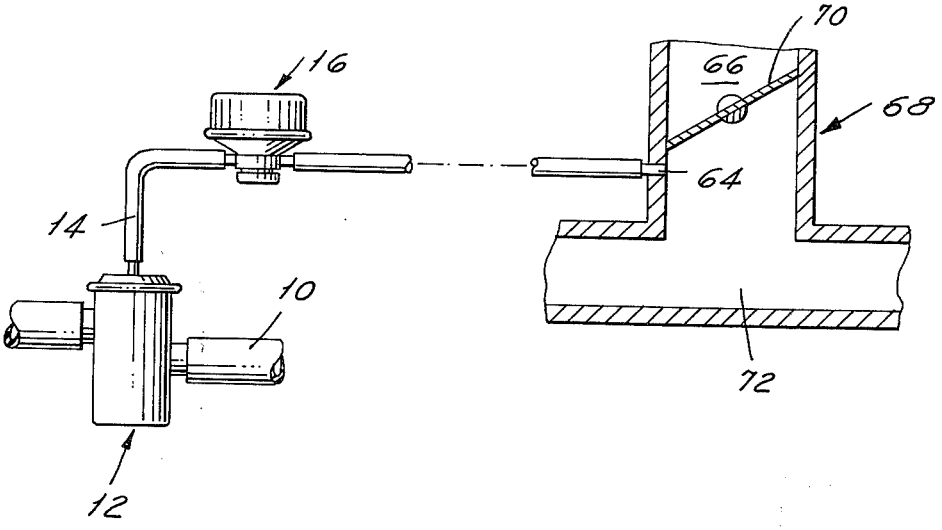

$$\Delta p_1 = (.02)(.034)\left(\frac{3.38/12}{0.1\text{ ft}}\right)\left(\frac{(217.5)^2}{64.4}\right)$$

$$\Delta p_1 = 1.41 \text{ psf or } 0.00978 \text{ psi}$$

for case when at 4000 r.p.m. (with insert) and $$\frac{\epsilon}{d} = \frac{0.005/12}{0.08} = 0.00521$$

then $f = 0.029$.

Accordingly $$\Delta p_2 = (.02)(.029)\ \frac{3.38/12}{.08}\ \frac{217.5}{64.4}^{\ 2}$$

$$\Delta p_2 = 1.5 \text{ psf or } 0.0034 \text{ psi}$$

$\Delta p_2 - \Delta p_1 = 7\%$ increase locally, but is actually 1/10 of overall total exhaust system back-pressure.

The latter is verified by:

$$(\Delta p_1/\Delta p \text{ total}) = \frac{(0.00978)(100)}{(17.6)(0.4912)} = 0.113\%$$

$$(\Delta p_2/\Delta p \text{ total}) = \frac{(0.01)(100)}{(17.6)(0.4912)} = 0.116\%$$

The overall back-pressure increase is thus insignificant with the use of the insert herein.

Alternative Liner Configuration

Other modes of constructing a liner which accomplishes the purpose as earlier indicated, can be as shown in FIGS. 4–6. The construction of FIG. 4 employs a spiral wound ceramic ply 43 or sheet (extending the distance 23) and which is radially spaced within such spiral configuration by corrugated ceramic web 44 (also extending the distance 23). The art of forming such spiral micropassages is generally known in the art and further teaching of this aspect can be taken from U.S. patents which are incorporated herein by reference. The central core region 45 is uninterrupted by having the inner edge 43*a* return and close radially outwardly. The radially outer region is subdivided by the spiral corrugated ceramic composite.

Another embodiment is that as shown in FIG. 5 wherein a honeycomb structure is employed which may be produced by a gasifying mixture to achieve the porous texture having a network of minute passages in the solidified form or by interrelating lattice walls 46 at right angles to each other to form an egg-crate subdivision in the outer region. Yet still another embodiment is that as shown in FIG. 6 where a plurality of plys of ceramic material may be maintained in parallel fashion extending chordally with respect to the circumference of the passage and separated transversely with respect to each other by corrugations of comparable ceramic material.

Parallel webs 47 are separated by corrugations 48 and occupy the total interior space of the passage 33 for said distance 23. A higher back pressure for the system is experienced with this mode.

Alternative Combustion Modes

Turning now to FIG. 7, there is illustrated an engine similar to that in FIG. 1 but differing in that it utilizes a stratified charge combustion process for creating programmed exhaust constituents having excess oxygen. A liner, according to this invention, is used in the exhaust passage of the engine block and a thermal reactor is used. Members of the various parts of the engine of FIG. 7 are numbered identical to that of FIG. 1 wherein they are similar. A lean mixture of air fuel is introduced into the main cylinder 11 by way of the induction passage 15, the lean mixture being controlled by carburetor 14 forming part of the induction system 9. A separate carburetor is used to introduce a rich mixture into a small prechamber 54 defined by cylindrical wall 55; the prechamber has an induction port 53 controlled by an induction valve 52. The induction valve 52 and primary intake valve 19 are coordinated by a suitable actuating assembly 50. The spark plug 51 is located so as to ignite the mixture solely within the prechamber 54 (as opposed to locating the spark plug in the main cylinder as in the embodiment of FIG. 1). The mixture in the prechamber will burn fast, thoroughly and operate to ignite the mixture in the main chamber 11 by the way of a torch effect which exits from the prechamber through a nozzle 56 or suitable port opening. The gas in the prechamber will burn extremely fast and thoroughly, keeping CO low. The temperature drops as the flame spreads to the main chamber where the lean mixture will burn more slowly. This minimizes hydrocarbon emissions without creating undue nitrogen oxide compounds. Since the engine is a four-cycle engine, the induction phase, where the combustible mixture is sucked into both the main chamber and prechamber, will draw a portion of the rich phase into a small upper region of the main chamber 11 through the nozzle 56; however, upon the compression stroke, the rich phase will, of course, return to the prechamber where it will be ignited by the spark plug 51 located solely therein. To this end, the main chamber 11 should be made non-symmetrical so that it facilitates the return of the rich phase during the compression cycle. Furthermore, the spark plug 51 should be recessed in such a manner that the induction of the rich phase will pass into the prechamber in a manner so as not to foul the spark plug.

To insure that excess oxygen and programmed exhaust emissions result, the volume of the prechamber should be smaller in comparison to the main chamber 11 and probably should not be greater than 10%. Nozzle 56 or other equivalent communicating port should be sized in relationship to the venturi controlling the induction of the air/fuel mixture into the prechamber. It is appropriate that the air/fuel mixture inducted into the prechamber should be preheated as the fuel/mixture is preheated for induction into the main chamber; this can be accomplished by heat exchange with the exhaust gases.

To achieve optimum gas economy and smoothness of operation, the concept of the stratified charge or compound controlled combustion can be applied to a rotary engine environment. To this end, FIGS. 9–13 illustrate how this may be accomplished utilizing a thermal reactor for the exhaust system. The rotary engine is of the two rotor type and has five housings including a front side housing 61, a front rotor housing 62, intermediate housing 63, rear side housing 64 and a rear

ENGINE DECELERATION VACUUM DIFFERENTIAL VALVE CONTROL

This invention relates in general to an air injection system for an internal combustion engine. More specifically, it relates to a valve constructed to operate during engine decelerations to divert manifold vacuum normally supplied to an engine control, to prevent exhaust backfire.

For emission control purposes, many motor vehicle type engines have secondary air injection systems in which an engine driven air pump supplies air to the exhaust ports to reduce unburned hydrocarbons and carbon monoxides to less harmful forms. These systems may also include catalytic converters that are also supplied with additional air. In connection with the latter, systems are known in which the secondary air is supplied continuously to the converter except during heavy accelerations, when the extra fuel and air could cause a burnout of the converter, or during engine decelerations, to prevent backfire. Generally the air is diverted to the atmosphere at this time by means of a manifold vacuum control.

This invention relates to a differential vacuum valve control to automatically shut off the application of manifold vacuum to a controlled device during engine decelerations to prevent backfire.

It is an object of the invention, therefore, to provide a control valve which during normal engine operation provides a continuous supply of manifold vacuum to a controlled device to permit the passage of secondary air through the engine emission system; however, during engine decelerations automatically terminates the flow of manifold vacuum to the device to prevent engine backfire.

It is another object of the invention to provide a valve construction that includes an engine manifold vacuum line having an air bleed controlled by a differential vacuum operated valve responsive to engine deceleration vacuum levels to momentarily open the bleed to provide a predetermined delay period during which no vacuum is supplied to the controlled device, and after which the bleed again is closed to provide a normal supply of manifold vacuum to the controlled device.

Figure 2:
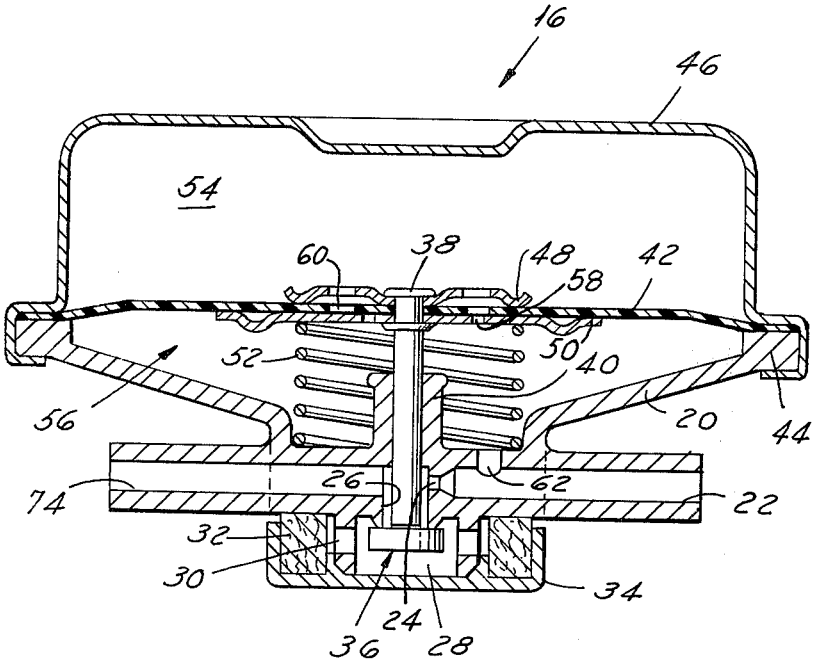

Other objects, features, and advantages of the invention will become more apparent upon reference to the succeeding detailed description thereof, and to the drawings illustrating the preferred embodiment thereof, wherein;

FIG. 1 schematically illustrates a portion of an internal combustion engine emission control system embodying the invention; and, FIG. 2 is an enlarged cross-sectional view of a detail shown in FIG. 1.

As stated above, FIG. 1 shows a portion of a system that is used to control the emission of undesirable elements into the atmosphere from an internal combustion engine. More specifically, the internal combustion engine, not shown, would have an air pump driven at engine speed to constantly supply so called secondary air through a conduit 10 to in this case a catalytic converter, not shown, as well as to the exhaust ports of the engine, in a known manner.

To protect the catalytic converter and also other portions of the engine, an air bypass valve 12 is provided that automatically schedules the flow of secondary air in passage 10. That is, the valve 12 is constructed to normally permit the flow of secondary air through passage 10 to the converter except during certain acceleration periods when larger quantities of the fuel mixture might damage the converter. During these times, such as, for example, when the manifold vacuum level drops below 2 in. Hg., the valve automatically shifts to block further flow of secondary air to the converter until the manifold vacuum level again rises above the 2 in. Hg. level. The valve is controlled by engine manifold vacuum in a line 14.

It will be clear from the above that during engine decelerations, when the manifold vacuum is very high, the air bypass valve normally will still continue to supply secondary air to the converter and exhaust system, which may cause backfire. Accordingly, the supply of manifold vacuum to the air bypass valve 12 is adapted to be shut off or terminated during engine decelerations by a differential vacuum operated air bleed valve 16 constructed according to the invention.

More specifically, FIG. 2 shows the control valve 16 as having a valve body 20 formed with a through manifold vacuum passage 22. Passage 22 is provided with a flow restricting orifice 24 connected to a central recess or opening 26. The latter constitutes an air vent or air bleed opening into a chamber 28 connected to atmosphere through an annular filter element 30 by passages 32. A dust cap 34 maintains the filter in place.

The air bleed opening 26 is adapted to be selectively opened or closed by a vacuum dump valve 36 fixed on a stem 38. The stem projects slidingly through a boss 40 of the valve body for connection to an annular flexible diaphragm 42. The latter is edge mounted against the top of the valve body at 44 and is clamped sealingly in place by a cover member 46. The valve stem 38 is riveted to a pair of spacers 48 and 50 located on opposite sides of the diaphragm. A compression spring 52 biases the diaphragm upwardly as seen in FIG. 2 to normally maintain the dump valve 36 closing the air vent.

The diaphragm, cover, and valve body together define a pair of chambers 54 and 56, chamber 54 constituting a quiescent one. It communicates with chamber 56 through a bypass timing orifice or flow restrictor 58, or alternately through a one-way check valve 60, in a manner to be described. Chamber 56 is directly connected to engine manifold vacuum, i.e., the vacuum source in passage 22, through a port 62.

Passage 22 can be connected to any portion of the engine intake manifold so as to be subject to the changes in manifold vacuum. For purposes of illustration, the passage is shown as connected to a manifold vacuum port 64 located in the induction passage 66 of a downdraft type carburetor 68 attached to the engine. The induction passage would contain the usual throttle valve 70 mounted for rotation in the passage to control the flow of fuel and air into the intake manifold indicated at 72. Changes in manifold vacuum with changes in load and speed and positions of the throttle valve 70 will be reflected in port 64 to passage 22.

The force of dump valve return spring 52 is chosen such that it will maintain diaphragm 42 in the position shown closing dump valve 36 for all engine operations other than decelerations where the manifold vacuum level exceeds a predetermined such as, for example, 20 in. Hg.

In operation, therefore, for all normal manifold vacuum levels, during normal engine operations, the vacuum acting in passage 22 through port 62 on diaphragm 42 will not be sufficient to overcome the force of spring 52 and unseat dump valve 36. Accordingly, flow of manifold vacuum will be maintained to the air bypass valve 12 to permit flow of secondary air to the catalytic converter, etc. During heavy accelerations, the drop in manifold vacuum will not change the position of the air dump valve 36; however, the drop in manifold vacuum level to below 2 in. Hg., will in this case trigger the air bypass valve 12 to interrupt the supply of secondary air from passage 10 past the valve until the manifold vacuum level again rises above the 2 in. Hg., level.

During the above operation, the bypass timing orifice 58 of the vacuum valve provides an equalization of pressure levels in both chambers 54 and 56. However, during engine decelerations, the sudden rise in vacuum level in chamber 56 is sufficient to overcome the force of spring 52 and immediately move the dump valve 36 down to open the air bleed. The flow restricting orifice 24 prevents the vacuum source in line 22 from being decayed significantly. However, this immediately admits air to the left hand portion 74 of passage 22 leading to the air bypass valve 12 and, therefore, triggers the latter valve to interrupt the supply of secondary air through passage 10. Concurrent with this action, the higher manifold vacuum in chamber 56 is being slowly bled through the bypass timing orifice 58 to chamber 54.

After a timing period of say two to ten seconds, for example, depending upon the level of deceleration vacuum, the pressure level in the two chambers 54 and 56 will equalize and permit spring 52 to again assume control of the movement of dump valve 36. Therefore, the dump valve will again be moved to a closed position shutting off the air bleed. Thus, after a predetermined time period, even with continued deceleration, the vacuum to the air bypass valve will again be restored. This is consistent with engine operation since the deceleration normally is a decreasing vacuum level event.

In the event that a sudden reacceleration occurs subsequent to the deceleration operation, the sudden change in manifold vacuum from a high level to a considerably lower level reflected in chamber 56 now reverses the vacuum differential force acting on dump valve 36. That is, the quiescent chamber 54 now is at a pressure level that is lower than that in chamber 56. This coupled with the force of spring 52 opens the check valve 60 to permit the immediate seating or closing of dump valve 36 by the open communication between the two chambers. This is desirable because the catalytic converter should be supplied immediately with secondary air during normal engine operations.

From the foregoing, it will be seen that the invention provides a vacuum differential valve control that operates to normally supply manifold vacuum to a controlled device at all times except during engine decelerations when it is desired to interrupt the supply, which the valve control does, and yet provides means to override the control feature to immediately restore the vacuum source to the controlled device, or restore the vacuum after a predetermined time delay sufficient to prevent backfire of the engine.

While the invention has been described and illustrated in a preferred embodiment, it will be clear to those skilled in the arts to which it pertains that many changes and modifications may be made thereto without departing from the scope of the invention.

I claim:

1. A vacuum flow control for use with an internal combustion engine having an intake manifold providing a source of vacuum varying from an essentially atmosphere pressure level during wide open throttle engine operations to a maximum subatmospheric level during engine decelerations, including a passage connecting the manifold vacuum to a vacuum unit, the passage having a flow restrictor and an air bleed between the restrictor and the unit for at times decaying the vacuum to the unit, a valve movable between a normal position closing the air bleed and a second position opening the air bleed, and valve actuating means connected to the valve and to the manifold vacuum and operative in response to deceleration operations of the engine increasing the manifold vacuum level above a predetermined value to move the air bleed valve to the second air bleed open position, the valve actuating means including other means operable to return the air bleed valve to the normal position closing the bleed even though the vacuum is above the predetermined level, the valve actuating means including a servo having movable piston means connected to the valve, means connecting manifold vacuum to opposite sides of the piston means for at times moving the valve to the second position by a differential vacuum force, a spring biasing the piston means towards the closed valve normal position, the other means comprising a flow restrictor in the piston means providing a delayed communication of the pressure levels on opposite sides of the piston means to each other whereby application of a manifold vacuum of a level above the predetermined level to one side of the piston means moves the valve to the second open air bleed position and maintains the valve in the second position until communication of the vacuum through the restrictor decays the differential vacuum force to a level permitting movement of the valve to the normal closed air bleed position by the spring.

2. A control as in claim 1, the piston means including a one-way check valve in a parallel flow arrangement with the flow restrictor whereby a sudden change of operation of the engine from a deceleration to an accelerating condition suddenly changing the vacuum level from above the predetermined level to below the level will open the check valve to immediately terminate the pressure differential to permit immediate movement of the valve by the spring to the normal position closing the air bleed.

* * * * *